United States Patent [19]

Morris

[11] 4,411,383

[45] Oct. 25, 1983

[54] CARTON AND INTEGRAL HANDLE THEREFOR

[75] Inventor: Charles K. Morris, Templestowe, Australia

[73] Assignee: Pak Pacific Corporation Pty. Limited, Victoria, Australia

[21] Appl. No.: 453,940

[22] Filed: Dec. 28, 1982

Related U.S. Application Data

[63] Continuation-in-part of Ser. No. 232,046, Jan. 23, 1981, abandoned.

[51] Int. Cl.[3] ..... B65D 5/46

[52] U.S. Cl. ..... 229/52 B; 229/37 R

[58] Field of Search ..... 229/52 B, 37 R, 54 R, 229/DIG. 6, DIG. 9; 150/12

[56] References Cited

U.S. PATENT DOCUMENTS

| | | | |
|---|---|---|---|
| 2,196,185 | 4/1940 | Belcher | 229/54 R |
| 2,210,937 | 8/1940 | Geimer | 229/54 R |
| 2,656,093 | 10/1953 | Smith | 229/54 R |
| 2,868,433 | 1/1959 | Anderson, Jr. | 229/52 B |
| 2,986,324 | 5/1961 | Anderson, Jr. | 229/52 B |
| 3,197,116 | 7/1965 | Zastrow | 229/52 B |
| 4,134,534 | 1/1979 | Scott et al. | 229/52 B |
| 4,378,905 | 4/1983 | Roccaforte | 229/52 B |

*Primary Examiner*—William Price
*Assistant Examiner*—Gary E. Elkins
*Attorney, Agent, or Firm*—Ladas & Parry

[57] ABSTRACT

A carton is provided where an end is closed by four flaps. One of the flaps is formed with a severable strip. A length of adhesive tape joins the ends of the strip to the carton, thus forming a handle for the carton.

4 Claims, 6 Drawing Figures

CARTON AND INTEGRAL HANDLE THEREFOR

This application is a continuation-in-part of U.S. application Ser. No. 232,046, filed Jan. 23, 1981, now abandoned the invention of which was described and claimed in international application no. PCT/AU 80 00027, and was described and claimed in Australian applications PD 9424 and PD 9627 which were filed on July 2, 1979, and July 18, 1979, respectively.

This invention relates to a carton and blank design which incorporates provision for a handle and relates particularly but not exclusively to carton blank/handle constructions which are suitable for use with relatively heavy contents such as packaged wine and to cartons constructed from same.

In one form the present invention provides a formed carton including at one end a pair of inner closing flaps and a pair of outer covering flaps adhered to said closing flaps, a handle strip connected to the end portion of one covering flap and extending across the carton and joined by a weakened zone to said covering flap; and an adhesive tape extending along said strip and onto the carton wall adjacent each end of said strip thereby to join said strip at its end to the carton, said strip being severable from the covering flap at said weakened zone, said handle strip generally lying flat across and bisecting the end of the carton, the other covering flap extending under the handle strip to push the handle strip above the level of the outer covering flaps, thereby providing a raised handle strip having an exposed edge along one length thereof to allow access for fingers.

The handle strip may be severable from the covering flaps by any means such as score lines, slits or perforations. It will be appreciated that in use the strip need only be severed from the closing flap to the extent necessary to allow for a person's fingers to pass beneath the strip.

Figure 1:
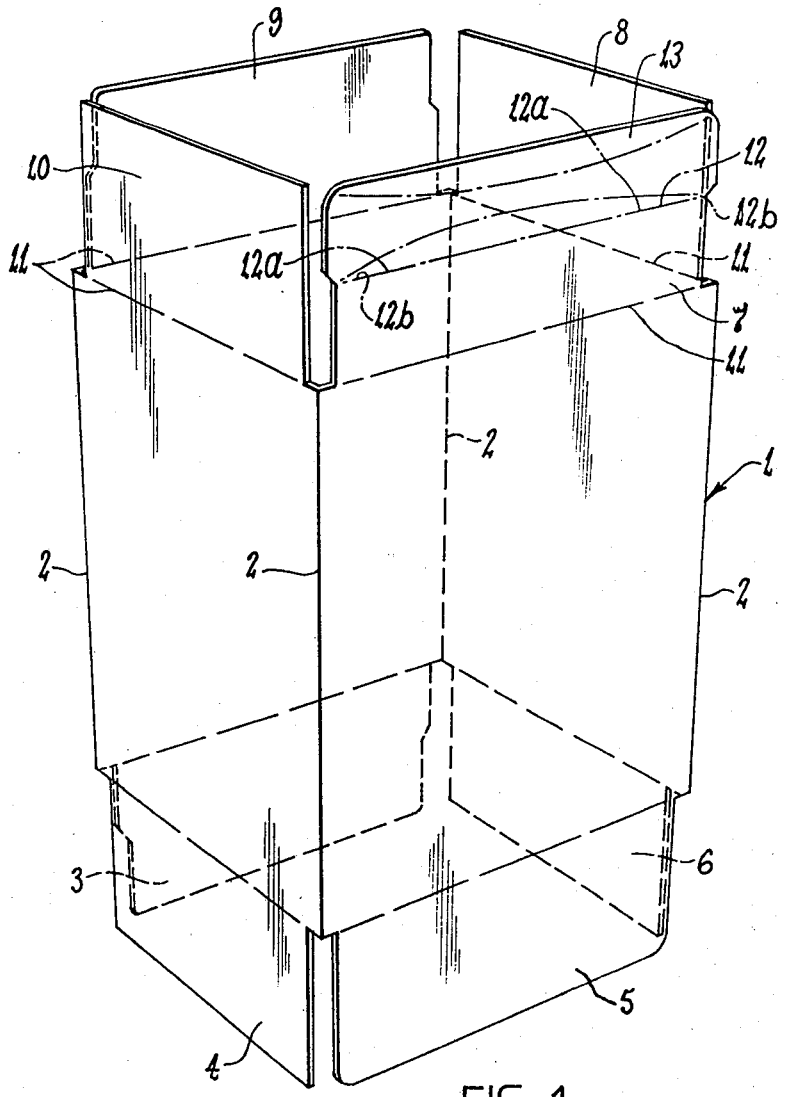

Preferred embodiments of the invention will now be described with reference to the accompanying drawings wherein:

FIG. 1 shows an elevation of a partly erected carton constructed in accordance with the invention; and, FIGS. 2, 3, 4, 5, and 6 illustrate the various stages taken in folding the flaps and forming a handle.

In FIG. 1, the carton 1 is of rectangular cross section and is constructed so that it can be readily erected from a flat blank by folding the blank along the fold lines 2 and joining opposed edges of the tubular partly formed carton by conventional means such as gluing. As the flaps 3, 4, 5 and 6 on the bottom end of the carton can be of any appropriate conventional configuration, the folding and gluing of this end will not be discussed further.

The flaps 7, 8, 9 and 10 are integral with the tubular body portion of the carton, the joint between each carton and flap including the fold lines 11, which can be formed by any conventional means such as creasing, cutting or scoring. One of the flaps 7 has a line of weakening 12, which runs across the major part of all of the width of the flap. The line of weakening which may comprise for example, slits, perforations or long cuts, 12*a*, interrupted by perforations 12*b*, is provided to facilitate tearing of the strip portion 13 from the rest of the flap. The length of flap 7 is preferably chosen so that the flap extends most, but not all the way across the carton end when it is folded flat. Thus the strip portion will lie generally across the middle of the carton end.

Figure 2:
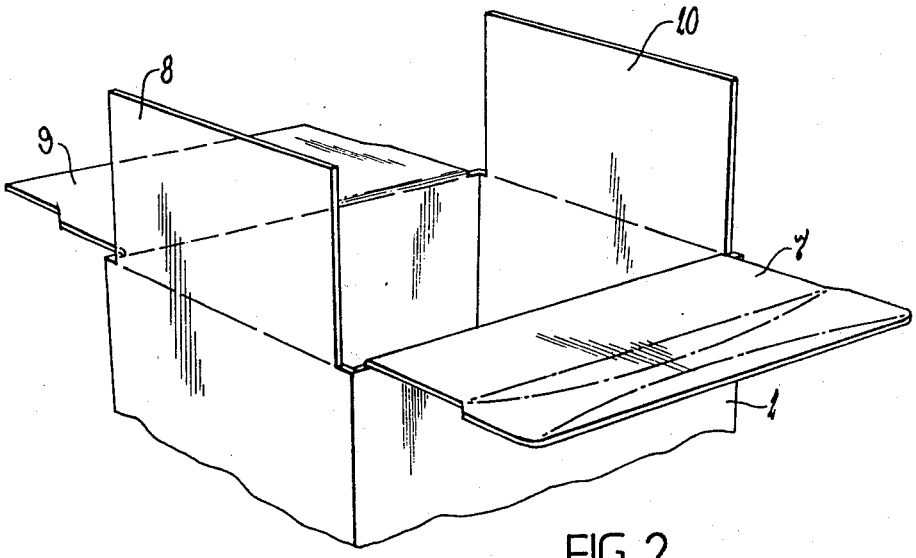
Figure 3:
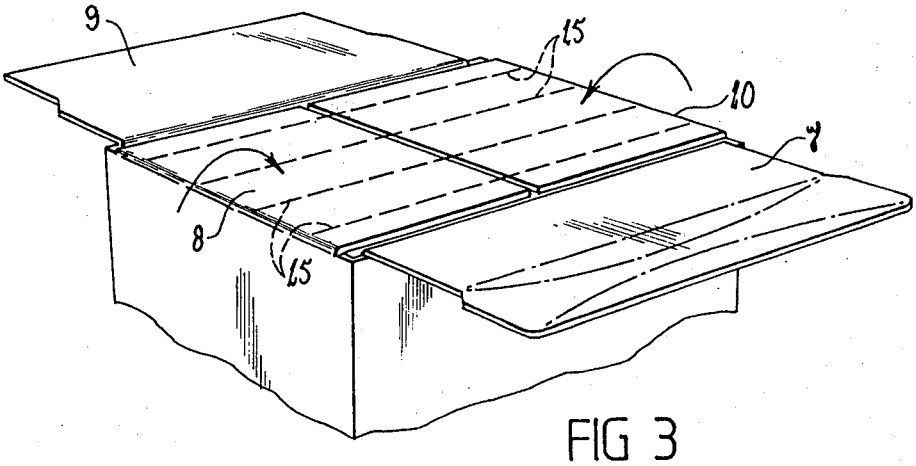
Figure 4:
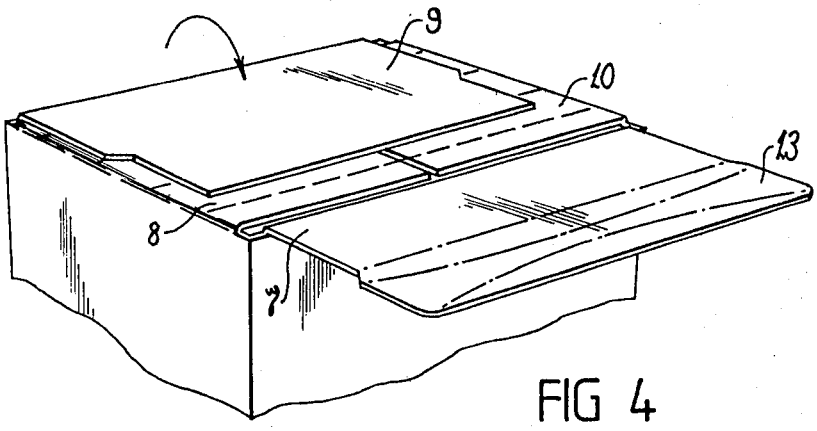
Figure 5:
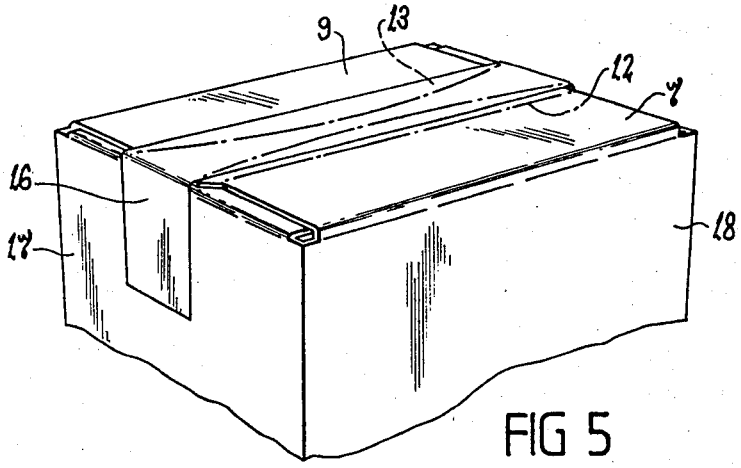
Figure 6:
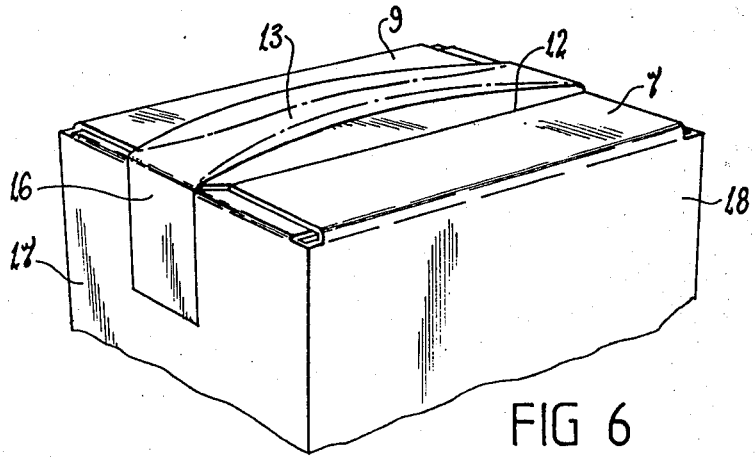

The steps a conventional box erecting machine may take to close the upper end of the carton involve bending back the flaps 7 and 9 in the manner illustrated in FIG. 2, so that they do not interfere with the folding of the flaps 8 and 10 as per FIG. 3. Adhesive, such as the lines of hot melt adhesive 15, can then be applied to the folded flaps 8 and 10, prior to the flap 9 being folded thereover in the manner illustrated in FIG. 4. The final flap 7 is then folded down as per FIG. 5, and glued to the flaps 8 and 10 lying underneath. A length of adhesive tape 16 is applied over the strip portion 13 of the flap. The adhesive tape extends beyond the edges of the strip to be secured to the opposed side walls 17 and 18. Thus when the strip is severed from the flap, a narrow carry handle stretching flat across the middle of the carton is formed in the manner shown in FIG. 6. The width of the strip may suitably be chosen so that the end of the remaining portion of flap 7 does not overlap the flap 9, but may be close to or substantially in abutment with the leading edge thereof. Thus, covering flap 9 extends under the handle strip portion 13 to push the strip above the level of the outer covering flaps. This provides a raised handle strip having an exposed edge along one length thereof to allow access for fingers.

What I claim is:

1. A formed carton including at one end a pair of inner closing flaps and a pair of outer covering flaps adhered to said closing flaps, a handle strip connected to the end portion of one covering flap and extending across the carton and joined by a weakened zone to said covering flap; and an adhesive tape extending along said strip and onto the carton wall adjacent each end of said strip thereby to join said strip at its ends to the carton, said strip being severable from the covering flap at said weakened zone, said handle strip generally lying flat across and bisecting the end of the carton, the other covering flap extending under the handle strip to push the handle strip above the level of the outer covering flaps, thereby providing a raised handle strip having an exposed edge along one length thereof to allow access for fingers.

2. A carton according to claim 1, wherein said weakened zone is provided by one or more score lines, slits, perforations or a combination thereof.

3. A carton as claimed in claim 1, wherein said strip is severable from the covering flap only to the extent necessary to provide a handle for the carton.

4. A carton as claimed in claim 1 wherein the leading edges of said outer covering flaps are substantially in abutment with each other when said strip is severed from said one covering flap.

* * * * *